US009566555B2

(12) United States Patent
Taha et al.

(10) Patent No.: US 9,566,555 B2
(45) Date of Patent: Feb. 14, 2017

(54) SELF-PRESSURIZATION GAS-LIQUID MIXING DEVICE USED FOR MAKING BEVERAGE

(71) Applicant: ADT (China) Ltd., Ningbo, Zhejiang (CN)

(72) Inventors: Max Taha, Zhejiang (CN); Ruofeng Weng, Zhejiang (CN)

(73) Assignee: ADT (China) Ltd., Ningbo, Zhejiang (CN)

( * ) Notice: Subject to any disclaimer, the term of this patent is extended or adjusted under 35 U.S.C. 154(b) by 0 days.

(21) Appl. No.: 14/981,568

(22) Filed: Dec. 28, 2015

(65) Prior Publication Data

US 2016/0184782 A1 Jun. 30, 2016

(30) Foreign Application Priority Data

Dec. 31, 2014 (CN) ..... 2014 1 0858069

(51) Int. Cl.
*B01F 3/04* (2006.01)
*B01F 5/06* (2006.01)

(52) U.S. Cl.
CPC ..... *B01F 3/04808* (2013.01); *B01F 3/04496* (2013.01); *B01F 5/0688* (2013.01); *B01F 5/0689* (2013.01)

(58) Field of Classification Search
CPC . B01F 3/04496; B01F 3/04808; B01F 5/0688; B01F 5/0689; B01F 15/0292
(Continued)

(56) References Cited

U.S. PATENT DOCUMENTS 2,132,854 A * 10/1938 Knott ..... A01J 11/16 138/42
6,613,219 B2 * 9/2003 Harter ..... B01D 3/008 208/146

(Continued)

FOREIGN PATENT DOCUMENTS

CN 202497831 U 10/2012

OTHER PUBLICATIONS

The State Intellectual Property Office of People's Republic of China, First Office Action in Chinese Patent Application No. CN 201410858069.8, issued Sep. 30, 2016.

(Continued)

*Primary Examiner* — Charles Bushey
(74) *Attorney, Agent, or Firm* — Novick, Kim & Lee, PLLC; Allen Xue

(57) ABSTRACT

A self-pressurization gas-liquid mixing device used for making a beverage is provided. The self-pressurization gas-liquid mixing device includes a container, a liquid inlet pipe configured to allow liquid to enter the container, a gas inlet pipe configured to allow gas to enter the container, and a liquid discharging pipe configured to discharge the liquid; a partition plate is arranged in the container to divide the container into a premixing chamber and a mixing chamber, the premixing chamber is arranged at the side of the liquid inlet pipe and the gas inlet pipe, the partition plate is provided with a plurality of premixing through holes, a mixing layer is further arranged between the mixing chamber and the liquid discharging pipe and includes a plurality of miniature pipes, and whisker holes which are opened and closed in one direction are formed in pipe walls of the miniature pipes.

7 Claims, 2 Drawing Sheets

(58) Field of Classification Search
USPC ..... 261/76, 96, 97, 109, 110, DIG. 7
See application file for complete search history.

(56) References Cited

U.S. PATENT DOCUMENTS

| | | | | |
|---|---|---|---|---|
| 6,824,675 | B2 * | 11/2004 | Boyer | B01D 3/008 137/896 |
| 7,238,329 | B2 * | 7/2007 | Boyer | B01D 3/008 208/209 |
| 7,601,310 | B2 * | 10/2009 | Breivik | B01J 8/008 422/224 |
| 7,651,076 | B2 * | 1/2010 | Harter | B01D 3/008 261/109 |
| 2004/0197245 | A1 * | 10/2004 | Boyer | B01F 3/04496 422/606 |
| 2010/0002535 | A1 * | 1/2010 | Cho | B01F 5/0682 366/107 |
| 2014/0212937 | A1 * | 7/2014 | Li | B01F 3/04496 435/139 |

OTHER PUBLICATIONS

Xinzhen Jiang et al., "Fundamentals of Chemical Industry Production", Chemical Industry Press, Sep. 30, 1983, cover page and p. 199.

* cited by examiner

SELF-PRESSURIZATION GAS-LIQUID MIXING DEVICE USED FOR MAKING BEVERAGE

TECHNICAL FIELD

The invention relates to a beverage making tool, in particular to a self-pressurization gas-liquid mixing device used for making a beverage.

BACKGROUND ART

For the beverage, gas shall be mixed into the liquid beverage usually. For example, much carbon dioxide shall be dissolved into the beverage when a carbonated beverage is prepared, and water and carbon dioxide are generally pressed into the gas-liquid mixing device of the beverage by a pressurization device such as a pump to achieve dissolution of carbon dioxide in water in the gas-liquid mixing device of the beverage. The defects in the prior art lie in that the liquid is mixed with another material directly according to a high-pressure method, and high pressure is required to be kept all the time during the whole process, so that not only the requirement on pressurization equipment, but also the requirement on high-pressure resistance of the whole gas-liquid mixing device is higher; moreover, the energy consumption of high-pressure equipment is much higher than that of low-pressure equipment.

SUMMARY

In order to overcome the defects in the prior art, the gas-liquid mixing device further comprises a premixing chamber, so as to ensure that the gas-liquid mixing device can self-raise gas pressure to meet the pressure requirement of gas-liquid mixing, and gas-liquid mixing requirements can be met under the condition that the provided pressure is relatively low.

The invention provides a self-pressurization gas-liquid mixing device used for making a beverage.

The self-pressurization gas-liquid mixing device comprises a container, a liquid inlet pipe configured to allow liquid to enter the container, a gas inlet pipe configured to allow gas to enter the container, and a liquid discharging pipe configured to discharge the liquid, wherein a partition plate is arranged in the container to divide the container into a premixing chamber and a mixing chamber, the premixing chamber is arranged at the side of the liquid inlet pipe and the gas inlet pipe, the partition plate is provided with a plurality of premixing through holes, a mixing layer is further arranged between the mixing chamber and the liquid discharging pipe and comprises a plurality of miniature pipes, whisker holes which are opened and closed in one direction are formed in pipe walls of each miniature pipe, and the gas and the liquid are pressed into the miniature pipes through the whisker holes from the exterior of the miniature pipes, further mixed in the miniature pipes, and flow into the liquid discharging pipe through ends of the miniature pipes.

Preferably, the partition plate is not thicker than 5 mm, and the apertures of the premixing through holes are 0.025 to 0.05 mm.

Preferably, the pressure of the gas entering the premixing chamber is controlled to be 2.8 to 3.8 bar, and the pressure of the liquid entering the premixing chamber is controlled to be 3 to 4.5 bar.

Preferably, the pressure in the mixing chamber is controlled to be 4.5 to 5 bar.

According to the technical schemes, the inner apertures of the miniature pipes are 0.1 to 0.5 microns.

According to the technical schemes, the lengths of the miniature pipes are 20 to 70 microns.

Preferably, the apertures of the whisker holes are 0.1 to 0.25 microns.

The principle of the self-pressurization gas-liquid mixing device is that due to the resisting function of the partition plate, though a pressure difference exists between pressure on two sides of the partition plate, gas in the mixing chamber cannot be pressed into the premixing chamber reversely; the liquid and the gas are driven by the gas pressure in the mixing chamber to enter the mixing layer and further be mixed and discharged through the liquid discharging pipe; after the discharged gas and liquid give rise to a pressure drop of the mixing chamber, the liquid mixed with the gas in the premixing chamber is pressed into the mixing chamber, and thus a continuous work process is kept always; after the liquid discharging pipe is closed, the liquid in the premixing chamber cannot enter the mixing chamber any more under the pushing action of the pressure in the mixing chamber, and the work process is stopped.

Compared with the prior art, the self-pressurization gas-liquid mixing device provided by the invention has the advantages that as the container is divided into the premixing chamber and the mixing chamber through the partition plate, and the mixing layer is arranged between the mixing chamber and the liquid discharging pipe; after the liquid with dissolved gas passes through the partition plate and enters the mixing chamber, part of the gas in the liquid escapes and raises the pressure in the mixing chamber to be higher than that in the premixing chamber; the gas is driven by the pressure in the mixing chamber to be sufficiently dissolved into the liquid in the miniature pipes of the mixing layer, and the liquid is also driven by the pressure in the mixing chamber to flow into the liquid discharging pipe, so that the pressure in the premixing chamber and the pressure in the mixing chamber are in a dynamic balance state, and the gas-liquid mixing device can be guaranteed to meet the gas-liquid mixing requirements and work continuously under the condition that the provided external pressure is relatively low.

The drawings are marked with the following reference signs according to the drawings:

1-Container, 2-Liquid inlet pipe, 3-Gas inlet pipe, 4-Liquid discharging pipe, 5-Partition plate, 51-Premixing through hole, 6-Premixing chamber, 7-Mixing chamber, 8-Mixing layer, 81-Miniature pipe, 82-Pipe wall, 821-Whisker hole, 822-Whisker, 9-Accommodating chamber.

Embodiments

A particular embodiment of the invention is described in detail according to the drawings, but it shall be understood that the protection scope of the invention is not limited by the particular embodiment.

Figure 1:
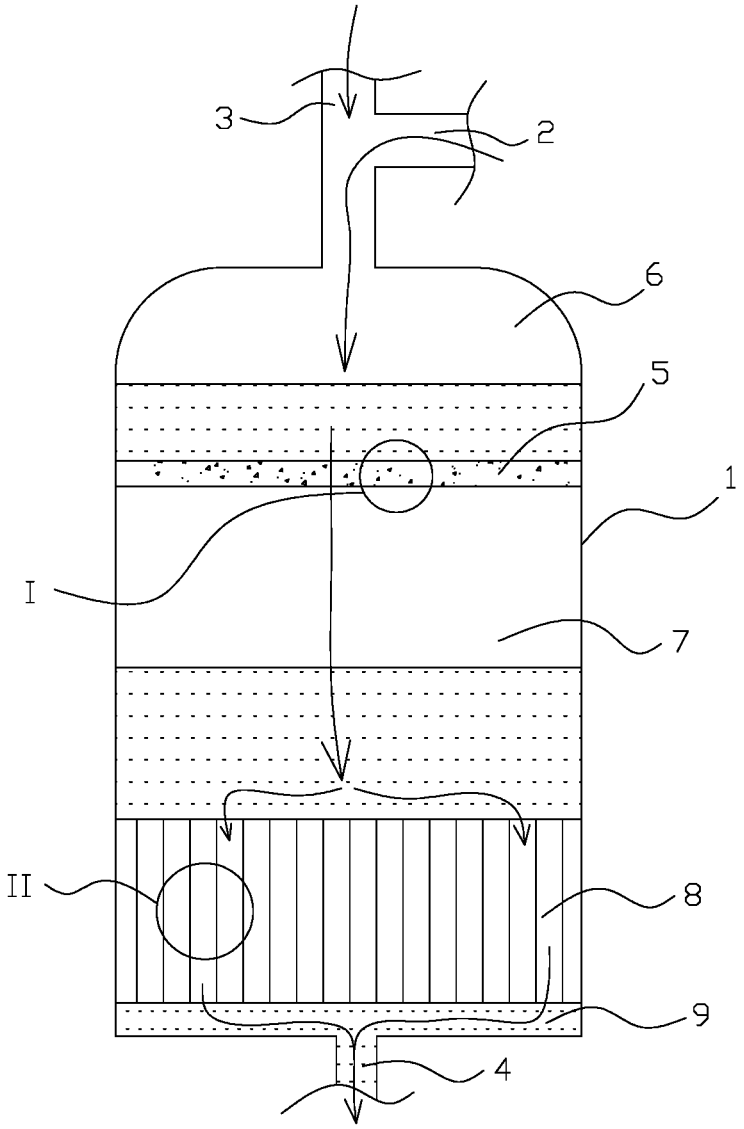
FIG. 1 is a diagram of a gas-liquid mixing device used for making a beverage.
Figure 2:
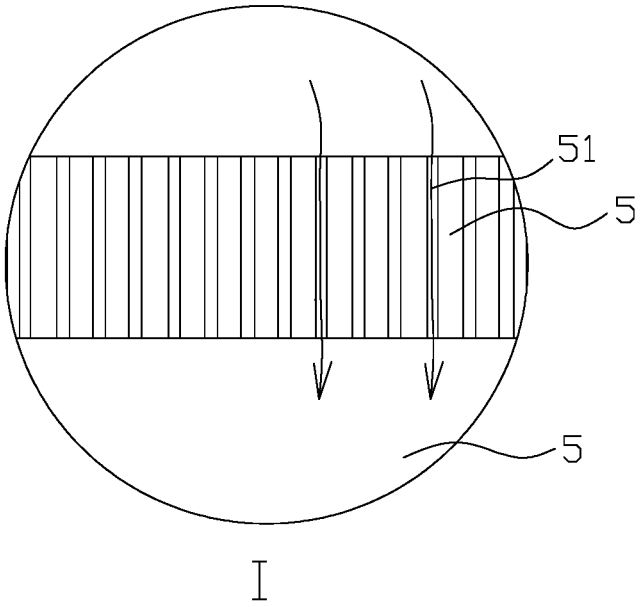
FIG. 2 is a partial enlarged diagram I of FIG. 1.
Figure 3:
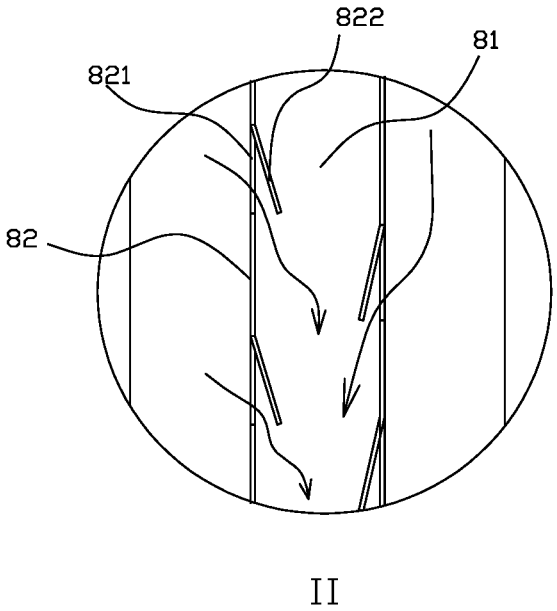
FIG. 3 is a partial enlarged diagram II of FIG. 1.

The invention relates to a gas-liquid mixing device of a beverage as shown in FIGS. 1, 2 and 3.

The gas-liquid mixing device comprises a container 1, a liquid inlet pipe 2 configured to allow liquid to enter the container 1, a gas inlet pipe 3 configured to allow gas to enter the container 1, and a liquid discharging pipe 4 configured to discharge the liquid, wherein a partition plate 5 not thicker than 5 mm is arranged in the container 1 to divide the container 1 into a premixing chamber and a mixing chamber 7, the premixing chamber is arranged at the side of the liquid inlet pipe and the gas inlet pipe and configured to receive the gas and the liquid which are pressed from the exterior, the pressure of the gas entering the premixing chamber 6 is controlled to be 2.8 to 3.8 bar, and the pressure of the liquid entering the premixing chamber is controlled to be 3 to 4.5 bar; the partition plate 5 is provided with a plurality of premixing through holes 51, and the apertures of the premixing through holes 51 are 0.025 to 0.05 mm; after the gas and the liquid are mixed in the premixing chamber, the liquid with dissolved gas enters the mixing chamber after passing through the premixing through holes; part of the gas in the liquid entering the mixing chamber escapes, and the pressure in the mixing chamber is raised to be 4.5 to 5 bar; a mixing layer 8 is further arranged between the mixing chamber 7 and the liquid discharging pipe 4, the liquid and the gas in the mixing chamber 7 pass through the mixing layer 8 under the action of pressure, the gas continues to dissolve into the liquid in the mixing layer till a set dissolving rate is reached, and then the liquid is discharged through the liquid discharging pipe 4 for external use; the mixing layer 8 comprises miniature pipes 81 which are arranged in an array, whisker holes 821 which are opened and closed in one direction are formed in pipe walls 82 of the miniature pipes 81, and the whisker holes are connected with whiskers 822 extending into the corresponding pipes; when the pressure in the miniature pipes is larger than that outside the miniature pipe, the whiskers 822 closes the whisker holes 821 completely, so that the liquid can pass through the miniature pipe in only one direction; the gas and the liquid are pressed into the miniature pipes 8 through the whisker holes 821 from the exterior of the miniature pipes 8, are further mixed in the miniature pipes 8 and flow into the liquid discharging pipe 4 through ends of the miniature pipes 8.

Furthermore, as shown in FIGS. 1, 2 and 3, the inner apertures of the miniature pipes are 0.1 to 0.5 microns; the lengths of the miniature pipes are 20 to 70 mm; the apertures of the whisker holes are 0.1 to 0.25 microns.

The principle of the self-pressurization gas-liquid mixing device is that due to the resisting function of the partition plate, though a pressure difference exists between pressure on two sides of the partition plate, gas in the mixing chamber cannot be pressed into the premixing chamber reversely; the liquid and the gas are driven by the gas pressure in the mixing chamber to enter the mixing layer and further be mixed and discharged through the liquid discharging pipe; after the discharged gas and liquid give rise to a pressure drop of the mixing chamber, the pressure balance state between the premixing chamber and the mixing chamber is broken through, the liquid mixed with the gas in the premixing chamber is pressed into the mixing chamber, and thus a continuous work process is kept always; after the liquid discharging pipe is closed, the liquid in the premixing chamber cannot enter the mixing chamber any more under the pushing action of the pressure in the mixing chamber, and the work process is stopped.

Compared with the prior art, the self-pressurization gas-liquid mixing device provided by the invention has the advantages that as the container is divided into the premixing chamber and the mixing chamber through the partition plate, and the mixing layer is arranged between the mixing chamber and the liquid discharging pipe; after the liquid with dissolved gas passes through the partition plate and enters the mixing chamber, part of the gas in the liquid escapes and raises the pressure in the mixing chamber to be higher than that in the premixing chamber; the gas is driven by the pressure in the mixing chamber to be sufficiently dissolved into the liquid in the miniature pipes of the mixing layer, and the liquid is also driven by the pressure in the mixing chamber to flow into the liquid discharging pipe, so that the pressure in the premixing chamber and the pressure in the mixing chamber are in a dynamic balance state, and the gas-liquid mixing device can be guaranteed to meet the gas-liquid mixing requirements and work continuously under the condition that the provided external pressure is relatively low.

The above disclosed is only one particular embodiment of the invention. However, the invention is not limited to this, and any change capable of being thought by one with skill in the art shall fall into the protection scope of the invention.

The invention claim is:

1. A self-pressurization gas-liquid mixing device used for making a beverage, comprising a container, a liquid inlet pipe configured to allow liquid to enter the container, a gas inlet pipe configured to allow gas to enter the container, and a liquid discharging pipe configured to discharge the liquid, wherein a partition plate is arranged in the container to divide the container into a premixing chamber and a mixing chamber, the premixing chamber is arranged at the side of the liquid inlet pipe and the gas inlet pipe, the partition plate is provided with a plurality of premixing through holes, a mixing layer is further arranged between the mixing chamber and the liquid discharging pipe and comprises a plurality of miniature pipes, whisker holes which are opened and closed in one direction are formed in the pipe walls of the miniature pipes, and the gas and the liquid are pressed into the miniature pipes through the whisker holes from the exterior of the miniature pipes and flow into the liquid discharging pipe through ends of the miniature pipes.

2. The self-pressurization gas-liquid mixing device used for making the beverage of claim 1, wherein the partition plate is not thicker than 5 mm, and the apertures of the premixing through holes are 0.025 to 0.05 mm.

3. The self-pressurization gas-liquid mixing device used for making the beverage of claim 1, wherein the pressure of the gas entering the premixing chamber is controlled to be 2.8 to 3.8 bar, and the pressure of the liquid entering the premixing chamber is controlled to be 3 to 4.5 bar.

4. The self-pressurization gas-liquid mixing device used for making the beverage of claim 3, wherein the pressure in the mixing chamber is 4.5 to 5 bar.

5. The self-pressurization gas-liquid mixing device used for making the beverage of claim 4, wherein the inner apertures of the miniature pipes are 0.1 to 0.5 microns.

6. The self-pressurization gas-liquid mixing device used for making the beverage of claim 5, wherein the lengths of the miniature pipes are 20 to 70 mm.

7. The self-pressurization gas-liquid mixing device used for making the beverage of claim 5, wherein the apertures of the whisker holes are 0.1 to 0.25 microns.

* * * * *